US009905362B2

(12) United States Patent
Ichigozaki et al.

(10) Patent No.: US 9,905,362 B2
(45) Date of Patent: Feb. 27, 2018

(54) RARE-EARTH MAGNET PRODUCTION METHOD

(71) Applicants: Daisuke Ichigozaki, Nisshin (JP); Noritaka Miyamoto, Toyota (JP); Tetsuya Shoji, Toyota (JP); Yuya Ikeda, Toyota (JP); Akira Manabe, Miyoshi (JP)

(72) Inventors: Daisuke Ichigozaki, Nisshin (JP); Noritaka Miyamoto, Toyota (JP); Tetsuya Shoji, Toyota (JP); Yuya Ikeda, Toyota (JP); Akira Manabe, Miyoshi (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 365 days.

(21) Appl. No.: 14/436,959

(22) PCT Filed: Oct. 17, 2013

(86) PCT No.: PCT/JP2013/078191
§ 371 (c)(1),
(2) Date: Apr. 20, 2015

(87) PCT Pub. No.: WO2014/065188
PCT Pub. Date: May 1, 2014

(65) Prior Publication Data

US 2015/0287530 A1 Oct. 8, 2015

(30) Foreign Application Priority Data

Oct. 23, 2012 (JP) ..... 2012-233812
Oct. 10, 2013 (JP) ..... 2013-212883

(51) Int. Cl.
*H01F 41/02* (2006.01)
*B22F 3/20* (2006.01)
(Continued)

(52) U.S. Cl.
CPC ..... *H01F 41/0266* (2013.01); *B22F 3/14* (2013.01); *B22F 3/17* (2013.01); *B22F 3/20* (2013.01);
(Continued)

(58) Field of Classification Search
CPC .... B22F 3/14; B22F 2998/10; B22F 2999/00; B22F 3/17; B22F 3/20; B22F 2009/048;
(Continued)

(56) References Cited

U.S. PATENT DOCUMENTS 4,881,984 A * 11/1989 Chandhok ..... H01F 1/0576 148/101
5,085,716 A * 2/1992 Fuerst ..... H01F 1/058 148/301
(Continued)

FOREIGN PATENT DOCUMENTS

JP 2-250918 A 10/1990
JP 2-250919 A 10/1990
(Continued)

*Primary Examiner* — Colleen P Dunn
*Assistant Examiner* — Nicholas A Wang
(74) *Attorney, Agent, or Firm* — Sughrue Mion, PLLC

(57) ABSTRACT

A method for manufacturing a rare-earth magnet, through hot deformation processing, having a high degree of orientation at the entire area thereof and high remanence, without increasing processing cost including a step of press-forming powder as a rare-earth magnetic material to form a compact S; and a step of performing hot deformation processing to the compact S, thus manufacturing the rare-earth magnet C. The hot deformation processing includes two steps of extruding and upsetting. The extruding is to place a compact S in a die Da, and apply pressure to the compact S' in a heated state with an extrusion punch PD so as to reduce the thickness for extrusion to prepare the rare-earth magnet intermediary body S" having a sheet form, and the upsetting is to apply pressure to the rare-earth magnet intermediary
(Continued)

body S" in the thickness direction to reduce the thickness, thus manufacturing the rare-earth magnet C.

5 Claims, 13 Drawing Sheets

(51) Int. Cl.
*C22C 28/00* (2006.01)
*H01F 1/057* (2006.01)
*B22F 3/17* (2006.01)
*B22F 3/14* (2006.01)

(52) U.S. Cl.
CPC ..... *C22C 28/00* (2013.01); *H01F 1/0576* (2013.01); *B22F 2003/208* (2013.01); *B22F 2998/10* (2013.01); *B22F 2999/00* (2013.01); *H01F 41/0273* (2013.01)

(58) Field of Classification Search
CPC ..... B22F 2202/05; B22F 2003/208; H01F 1/0576; H01F 41/0273
USPC ..... 148/105
See application file for complete search history.

(56) References Cited

U.S. PATENT DOCUMENTS

| | | | | |
|---|---|---|---|---|
| 5,125,988 | A * | 6/1992 | Akioka | B22F 9/023 148/101 |
| 2008/0055031 | A1* | 3/2008 | Esaki | B22F 3/20 335/302 |
| 2013/0321112 | A1 | 12/2013 | Miyamoto et al. | |

FOREIGN PATENT DOCUMENTS

| | | | |
|---|---|---|---|
| JP | 2-250920 | A | 10/1990 |
| JP | 2-250922 | A | 10/1990 |
| JP | 4-44301 | A | 2/1992 |
| JP | 4-134804 | A | 5/1992 |
| JP | 5-129128 | A | 5/1993 |
| JP | H05129128 | * | 5/1993 |
| JP | 10-163054 | A | 6/1998 |
| JP | 2008-91867 | A | 4/2008 |
| JP | 2012174986 | A | 9/2012 |

* cited by examiner (In-plane anisotropy:1.36)

(When difference between L-direction stretching and W-direction stretching is large)

(In-plane anisotropy: 1.07)
(When difference between L-direction stretching and W-direction stretching is small)

RARE-EARTH MAGNET PRODUCTION METHOD

CROSS REFERENCE TO RELATED APPLICATIONS

This application is a National Stage of International Application No. PCT/JP2013/078191 filed Oct. 17, 2013, claiming priority based on Japanese Patent Application Nos. 2012-233812, filed Oct. 23, 2012, and 2013-212883, filed Oct. 10, 2013, the contents of all of which are incorporated herein by reference in their entirety.

TECHNICAL FIELD

The present invention relates to a method for manufacturing a rare-earth magnet.

BACKGROUND ART

Rare-earth magnets containing rare-earth elements such as lanthanoide are called permanent magnets as well, and are used for motors making up a hard disk and a MRI as well as for driving motors for hybrid vehicles, electric vehicles and the like.

Indexes for magnet performance of such rare-earth magnets include remanence (residual flux density) and a coercive force. Meanwhile, as the amount of heat generated at a motor increases because of the trend to more compact motors and higher current density, rare-earth magnets included in the motors also are required to have improved heat resistance, and one of important research challenges in the relating technical field is how to keep magnetic characteristics of a magnet at high temperatures.

Rare-earth magnets include typical sintered magnets including crystalline grains (main phase) of about 3 to 5 μm in scale making up the structure and nano-crystalline magnets including finer crystalline grains of about 50 nm to 300 nm in nano-scale. Among them, nano-crystalline magnets capable of decreasing the amount of expensive heavy rare-earth elements to be added while making the crystalline grains finer attract attention currently.

The following briefly describes one example of the method for manufacturing a rare-earth magnet. For instance, Nd—Fe—B molten metal is solidified rapidly to be fine powder, while pressing-forming the fine powder to be a compact. Hot deformation processing is then performed to this compact to give magnetic anisotropy thereto to prepare a rare-earth magnet (orientational magnet).

Various techniques have been disclosed for this hot deformation processing. In typical hot deformation processing, upsetting is performed, in which a compact (bulk) obtained by shaping magnetic powder is placed into a die, and pressure is applied to the compact with punches. Such upsetting, however, has a big problem that cracks (including micro-cracks) are generated at the outermost periphery of the rare-earth magnet processed where tensile stress is generated. That is, in the case of upsetting, the periphery part hangs over due to the friction acting on the end face of the rare-earth magnet, which causes such tensile stress. A Nd—Fe—B rare-earth magnet has weak tensile strength against this tensile stress, and so it is difficult for such a magnet to suppress the cracks due to such tensile stress. For instance, such cracks may be generated when the processing ratio is about 40 to 50%. The distribution of strains is equivalent to the non-uniformity of remanence (Br), and especially remanence is extremely low at a strain region of 50% or less, meaning that the material yield is low. To solve these problems, frictional resistance may be decreased, but a conventional method in which hot lubrication is performed depends on fluid lubrication only, and so it is difficult to use such a method for upsetting using an open system.

Such cracks generated at a rare-earth magnet cause the processing deformation that is formed to improve the degree of orientation to be open at the positions of the cracks, thus failing to direct the deformation energy to the crystalline orientation sufficiently. This becomes a factor to inhibit the improvement in remanence.

Then to solve the problem of cracks generated during upsetting as stated above, Patent Literatures 1 to 5 disclose techniques, in which a compact as a whole is enclosed into a metal capsule, followed by hot deformation processing while pressing this metal capsule with upper and lower punches. According to these techniques, they say that magnetic anisotropy of the rare-earth magnet can be improved while suppressing cracks that are a problem during hot deformation processing.

Although they say that the techniques disclosed in Patent Literatures 1 to 5 can solve cracks, it is known that such a method of enclosing the compact in a metal capsule causes the rare-earth magnet obtained by the hot deformation processing to receive strong constraints from the metal capsule due to a difference in thermal expansion during cooling and so generate cracks. In this way, cracks will be generated when a metal capsule is used as well, and to avoid such a problem, Patent Literature 6 discloses a method of making a metal capsule thinner by upsetting through multiple steps, so as to decrease the constraints from the metal capsule. For instance, Patent Literature 6 discloses the embodiment, in which an iron plate of 7 mm or more in thickness is used. Such an iron plate of 7 mm or more in thickness, however, cannot be said thin enough to prevent cracks completely, and it is known that cracks generate actually in that case. Additionally the shape of the magnet after upsetting cannot be said a near net shape, which requires finish processing at the entire face, thus leading to disadvantages such as a decrease in material yield and an increase in processing cost due to the addition of processing cost.

When the thickness of a metal capsule covering the entire face of a compact completely is made thinner to be the degree of thickness that is not disclosed in the conventional techniques, such a capsule will be broken at the rate of strain of 1/sec or more, which causes discontinuous unevenness at the rare-earth magnet processed and so causes a disturbance of orientation. In this way, such a method hardly expects high remanence.

Then instead of upsetting that has been used typically, a method of using extruding for hot deformation processing may be considered, so as to give strain to a compact.

For instance, Patent Literature 7 discloses a method for extruding, in which the dimension in X-direction of the extruded cross section at a permanent magnet that is extruded from a pre-compact for shaping is narrowed, whereas the dimension in Y-direction orthogonal thereto is expanded, so that the ratio of strain $\epsilon_2/\epsilon_1$ is in the range of 0.2 to 3.5 where $\epsilon_1$ denotes a strain in the extrusion direction at the permanent magnet with reference to the pre-compact, and $\epsilon_2$ denotes a strain in Y-direction. While conventional extruding is typically to get an annular shape, the method disclosed in Patent Literature 7 is to extrude to have a sheet-formed shape.

That is, this method aims to increase the degree of orientation by controlling the stretching in the compression direction and in the direction perpendicular thereto. In order to practically control the stretching in these orthogonal directions precisely, the forming mold has to have a complicated shape, meaning an increase in cost for equipment. Additionally, although extruding can introduce a uniform strain in the travelling direction, it has a large friction area with the forming mold, and so the product obtained tends to have an area with low strain at its center. This is because extruding enables processing by giving compression and shear only, and so cracks due to tension can be suppressed, conversely meaning that the surface of the extruded product becomes a high-strain area because it always receives friction and the center becomes a low-strain area.

Furthermore such extruding requires a forming mold made of a material having high strength at high temperatures because a force at about 200 MPa acts thereon at a temperature near 800° C. when crystals of a Nd—Fe—B rare-earth magnet, for example, are to be oriented by hot deformation processing. For instance, Inconel or, carbide is preferable as such a material of the forming mold, but these carbide metals are difficult to cut, meaning a large burden on the processing cost. When extruding is performed to get a sheet form as in the technique disclosed in Patent Literature 7, stress will be concentrated at the corners of the extruded product because of such a shape, as compared with an annular extruded product. In such a case, the durability of the forming mold will deteriorate, and so the number of products that can be produced with one forming mold will be decreased, which also becomes a factor to increase the processing cost. Although the technique disclosed in Patent Literature 7 aims to improve the performance of the processed product, the shape of extruding is actually complicated three-dimensionally, and so the processing is enabled only with separated molds, and an increase in processing cost is large.

In this way, the development of a method for manufacturing a rare-earth magnet through hot deformation processing is needed so that the rare-earth magnet produced has favorable strains at the entire area and has high degree of orientation and so high remanence without increasing processing cost therefor.

CITATION LIST

Patent Literatures

Patent Literature 1: JP H02-250920 A
Patent Literature 2: JP H02-250922 A
Patent Literature 3: JP H02-250919 A
Patent Literature 4: JP H02-250918 A
Patent Literature 5: JP H04-044301 A
Patent Literature 6: JP H04-134804 A
Patent Literature 7: JP 2008-91867 A

SUMMARY OF INVENTION

Technical Problem

In view of the problems as stated above, the present invention aims to provide a method for manufacturing a rare-earth magnet through hot deformation processing, capable of manufacturing a rare-earth magnet having favorable strains at the entire area and having high degree of orientation and so high remanence, without increasing processing cost therefor.

Solution to Problem

In order to fulfill the object, a method for manufacturing a rare-earth magnet of the present invention includes: a first step of press-forming powder as a rare-earth magnetic material to form a compact, the powder including a RE-Fe—B main phase (RE: at least one type of Nd and Pr) and an RE-X alloy (X: metal element) grain boundary phase around the main phase; and a second step of performing hot deformation processing to the compact to give magnetic anisotropy to the compact, thus manufacturing the rare-earth magnet. The hot deformation processing at the second step includes two steps that are extruding performed to prepare a rare-earth magnet intermediary body and upsetting performed to the rare-earth magnet intermediary body to manufacture the rare-earth magnet, the extruding is to place a compact in a die, and apply pressure to the compact with an extrusion punch so as to reduce a thickness of the compact for extrusion to prepare the rare-earth magnet intermediary body having a sheet form, and the upsetting is to apply pressure to the sheet-form rare-earth magnet intermediary body in the thickness direction to reduce the thickness, thus manufacturing the rare-earth magnet.

In the manufacturing method of the present invention, the hot deformation processing is performed in the order of extruding and upsetting, whereby the area of low degree of strains at the center area of the extruded product (rare-earth magnet intermediary body) that often occurs during extruding can have high-degree of strains given from the following upsetting, whereby the rare-earth magnet manufactured can have high-degree of strains at the entire area favorably, and accordingly the rare-earth magnet manufactured can have high degree of orientation and high remanence.

The manufacturing method of the present invention includes, as the first step, the step of press-forming powder as a rare-earth magnetic material to form a compact.

Rare-earth magnets as a target of the manufacturing method of the present invention include not only nano-crystalline magnets including a main phase (crystals) making up the structure of about 200 nm or less in grain size but also those of about 300 nm or more in grain size as well as sintered magnets and bond magnets including crystalline grains bound with resin binder of 1 μM or more in grain size. Among them, it is desirable that the dimensions of the main phase of magnet powder before the hot deformation processing are adjusted so that the rare-earth magnet finally manufactured has the main phase having the average maximum dimension (average maximum grain size) of about 300 to 400 nm or less.

A melt-spun ribbon (rapidly quenched ribbon) as fine crystal grains is prepared by rapid-quenching of liquid, and the melt-spun ribbon is coarse-ground, for example, to prepare magnetic powder for rare-earth magnet. This magnetic powder is loaded into a die, for example, and is sintered while applying pressure thereto with punches to be a bulk, thus forming an isotropy compact.

This compact has a metal structure including a RE-Fe—B main phase of a nano-crystal structure (RE: at least one type of Nd and Pr, and more specifically any one type or two types or more of Nd, Pr, Nd—Pr) and a RE-X alloy (X: metal element) grain boundary phase surrounding the main phase.

At the second step, hot deformation processing is performed to the compact prepared at the first step to give magnetic anisotropy to the compact, thus manufacturing the rare-earth magnet in the form of an orientational magnet.

The second step includes two steps that are extruding performed to prepare a rare-earth magnet intermediary body and then upsetting performed to the rare-earth magnet intermediary body to manufacture the rare-earth magnet.

The extruding is to place the compact prepared at the first step in a die, and apply pressure to the compact with an extrusion punch so as to reduce a thickness of the compact for extrusion to prepare the rare-earth magnet intermediary body having a sheet form. This extruding process roughly has two processing forms. In one of the processing forms, an extrusion punch having a sheet-form hollow therein is used to press a compact with this extrusion punch so as to reduce the thickness of the compact while extracting a part of the compact into the hollow of the extrusion punch, thus manufacturing a sheet-form rare-magnet intermediary body, which is so-called backward extruding (a method of producing a rare-earth magnet intermediary body by extruding a compact in the direction opposite of the extruding direction of the punch). The other processing method is of placing a compact into a die having a sheet-form hollow therein and pressing the compact with a punch that does not have a hollow so as to reduce the thickness of the compact while extruding a part of the compact from the hollow of the die, thus manufacturing a sheet-form rare-earth magnet intermediary body, which is so-called forward extruding (a method of producing a rare-earth magnet intermediary body by extruding a compact in the extruding direction of the punch). In any of these methods, the extruding causes the rare-earth magnet intermediary body prepared by pressurization with the extrusion punch to have anisotropy in the direction perpendicular to the pressing direction with this extrusion punch. That is, the anisotropy is generated in the thickness direction of the sheet form of the sheet-form hollow of the extrusion punch.

Since the rare-earth magnet intermediary body prepared at this stage has a center area with low degree of strains compared with that at an outer area, meaning that such a center area has insufficient anisotropy.

Then, the upsetting is performed to the sheet-form rare-earth magnet intermediary body prepared by the extruding so as to press the rare-earth magnet intermediary body in the thickness direction thereof that is the anisotropic axis direction. This reduces the thickness of the rare-earth magnet intermediary body and gives strains the low-strain area at the center to have favorable anisotropy at the center, whereby a rare-earth magnet manufactured as a whole can have favorable anisotropy, and have high remanence.

In a preferable embodiment of the manufacturing method of the present invention, a processing ratio in the extruding, is 50 to 80% and a processing ratio in the upsetting is 10 to 50%.

Such numeral ranges for the two types of processing were found from the verifications by the present inventors. When the processing ratio of extruding is less than 50%, remanence at the time of extruding is low, and so the amount of processing during the following upsetting inevitably increases. As a result, the rare-earth magnet manufactured tends to generate cracks at the periphery. On the other hand, when the processing ratio of extruding exceeds 80%, strains at the time of extruding are too large, and so cracks easily occur in the crystalline structure, resulting in the tendency to decrease the remanence. Based on these results of the verification, such upper and lower values of the processing ratio for the extruding are specified.

When the processing ratio of the upsetting is less than 10%, strains cannot be given to the center of the rare-earth magnet intermediary body sufficiently, resulting in difficulty to produce a rare-earth magnet having high remanence as a whole. When the processing ratio exceeds 50%, cracks easily occur at the periphery of the rare-earth magnet produced due to tensile stress. Based on these results of the verification, such upper and lower values of the processing ratio for the upsetting are specified A modifier alloy such as a Nd—Cu alloy, a Nd—Al alloy, a Pr—Cu alloy, or a Pr—Al alloy may be grain-boundary diffused to the rare-earth magnet (orientational magnet) prepared at the second step, to further improve the coercive force of the rare-earth magnet. A Nd—Cu alloy has a eutectic point of about 520° C., a Pr—Cu alloy has a eutectic point of about 480° C., a Nd—Al alloy has a eutectic point of about 640° C. and a Pr—Al alloy has a eutectic point of about 650° C., all of which is greatly below 700 to 1,000° C. that causes coarsening of crystal grains making up a nano-crystalline magnet, and so they are especially preferable when the rare-earth magnet includes nano-crystalline magnet.

Preferably, in the RE-Fe—B main phase (RE: at least one type of Nd and Pr) of the powder as the rare-earth magnetic material, the content of RE is 29 mass %≤RE≤32 mass %, and the main phase of the rare-earth magnet manufactured has an average grain size of 300 nm or less.

If RE is less than 29 mass %, cracks tend to occur during hot deformation processing, meaning extremely poor orientation, and if RE exceeds 29 mass %, the strains from the hot deformation processing will be absorbed at a grain boundary that is soft, meaning poor orientation and a small ratio of the main phase, that is, leading to a decrease in residual flux density.

In a preferable embodiment of the manufacturing method of the present invention, let that, for the sheet-form rare-earth magnet intermediary body prepared by the extruding, a direction for the extruding is L direction, a direction orthogonal to the direction for the extruding is W direction, and a direction that is orthogonal to a plane defined with an axis in the L direction and an axis in the W direction and that is in the thickness direction of the sheet-form rare-earth magnet intermediary body is a C-axis direction that is an easy magnetization direction, stretching in the L direction and stretching in the W direction during the upsetting are adjusted so that an in-plane anisotropy index: Br(W)/Br(L) becomes 1.2 or less, the in-plane anisotropy index: Br(W)/Br(L) being represented with a ratio between remanence Br(W) in the W direction and remanence Br(L) in the L direction of the rare-earth magnet after the upsetting.

In order to give magnetic anisotropy in the easy magnetization direction (C-axis direction) of the rare-earth magnet, the manufacturing method of the present embodiment is configured to remove the anisotropy between the L-directional axis and the W-directional axis that define the plane orthogonal to the C-axis direction, or to minimize such anisotropy.

The L direction is the extruding direction, meaning that the rare-earth magnet intermediary body prepared by the extruding is stretched slightly in the W direction, but is stretched largely in the L direction. That is, the rare-earth magnet intermediary body prepared can have greatly improved magnetic characteristics in the L direction, but is less improved in magnetic characteristics in the W direction.

Then, in the upsetting (forging) following the extruding, the stretching in the W direction is increased relative to the stretching in the L direction this time, whereby the rare-earth magnet manufactured has similar magnetic characteristics between in the L direction and in the W direction, and so anisotropy can be removed in the face defined with the L-directional axis and the W-directional axis. As a result, the anisotropy in the easy magnetization direction (C-axis direction) that is orthogonal to the face defined with this L-directional axis and the W-directional axis can be increased, and so remanence Br of the rare-earth magnet can be improved.

The verification by the present inventors shows that stretching in the L direction and stretching in the W direction during the upsetting may be adjusted so that an in-plane anisotropy index: Br(W)/Br(L) becomes 1.2 or less, the in-plane anisotropy index: Br(W)/Br(L) being represented with a ratio between remanence Br(W) in the W direction and remanence Br(L) in the L direction, whereby the remanence in the C-axis direction can, be high.

It is also found that when a ratio between a stretching ratio in the W direction and a stretching ratio in the L direction during the upsetting: the stretching ratio in the W direction/the stretching ratio in the L direction ranges from 1 to 2.5, the in-plane anisotropy index: Br(W)/Br(L) becomes 1.2 or less.

In one embodiment for the method of adjusting stretching in the L direction and stretching in the W direction so that a ratio between a stretching ratio in the W direction and a stretching ratio in the L direction during the upsetting: the stretching ratio in the W direction/the stretching ratio in the L direction ranges from 1 to 2.5, a mold for the upsetting to place the rare-earth magnet intermediary body therein has dimensions adjusted, and such a mold having the dimensions yielding such a ratio may be used.

As another method, dimensions of a plane defined with the axis in the L direction and the axis in the W direction of the rare-earth magnet intermediary body prepared by the extruding may be adjusted. That is, when a rare-earth magnet intermediary body having a rectangle in the planar view is crushed by pressing with punches or the like vertically without being constrained at their side faces, the stretching of the intermediary body along the short sides is larger than the stretching along the long sides due to friction generated between the upper and lower faces of the rare-earth magnet intermediary body and the upper and lower punches. This method utilizes such an action, and adjusts the lengths of the sheet-form rare-earth intermediary body produced by the extracting so that the stretching ratio in the W direction/the stretching ratio in the L direction during upsetting ranges from 1 to 2.5, and then performs upsetting to such a rare-earth intermediary body having adjusted dimensions.

Advantageous Effects of Invention

As can be understood from the above descriptions, according to the manufacturing method of a rare-earth magnet of the present invention, hot deformation processing is performed in the order of extruding and upsetting, whereby the area of low degree of strains at the center area of the extruded product (rare-earth magnet intermediary body) that often occurs during extruding can have high-degree of strains given from the following upsetting, whereby the rare-earth magnet manufactured can have high-degree of strains at the entire area favorably, and accordingly the rare-earth magnet manufactured can have high degree of orientation and high remanence.

DESCRIPTION OF EMBODIMENTS

The following describes embodiments of a method for manufacturing a rare-earth magnet of the present invention, with reference to the drawings. The illustrated example describes a method for manufacturing a rare-earth magnet that is a nano-crystalline magnet, and the method for manufacturing a rare-earth magnet of the present invention is not limited to the manufacturing of a nano-crystalline magnet, which is applicable to the manufacturing of a sintered magnet having relatively large crystal grains (e.g., about 1 μm in grain size), for example, as well. Extruding at a second step in the illustrated example uses an extrusion punch having a sheet-form hollow therein to press a compact with this extrusion punch so as to reduce the thickness of the compact while extracting a part of the compact into the hollow of the extrusion punch, thus manufacturing a sheet-form rare-magnet intermediary body (backward extruding). Instead of the illustrated example, the method may be a processing method of placing a compact into a die having a sheet-form hollow therein and pressing the compact with a punch that does not have a hollow so as to reduce the thickness of the compact while extruding a part of the compact from the hollow of the die, thus manufacturing a sheet-form rare-earth magnet intermediary body (forward extruding).

(Embodiment 1 of Manufacturing Method of a Rare-Earth Magnet)

Figure 1A:
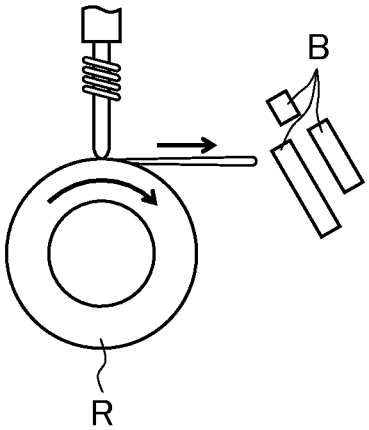
FIGS. 1*a* and 1*b* are schematically illustrate a first step of a method for manufacturing a rare-earth magnet that is Embodiment 1 of the present invention in this order.
Figure 1B:
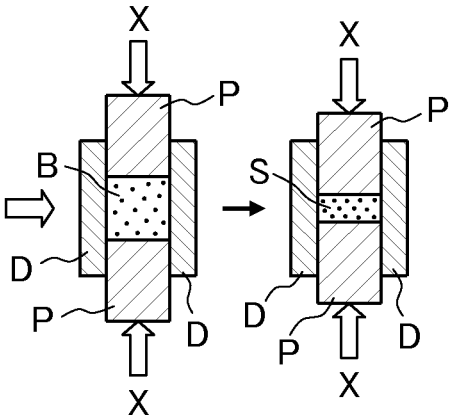
Figure 2:
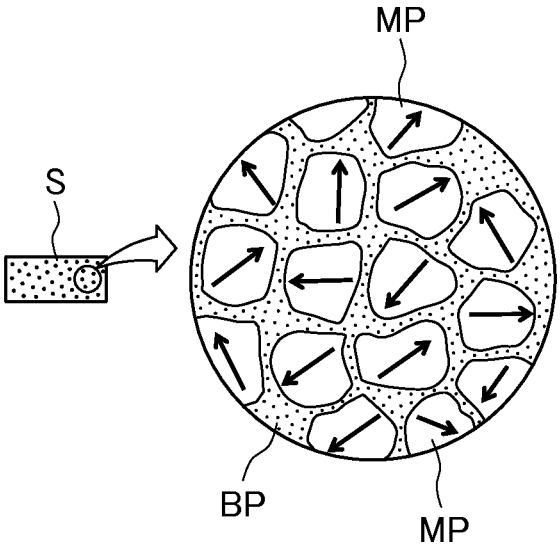
FIG. 2 illustrates the micro-structure of a compact that is manufactured by the first step.
Figure 3A:
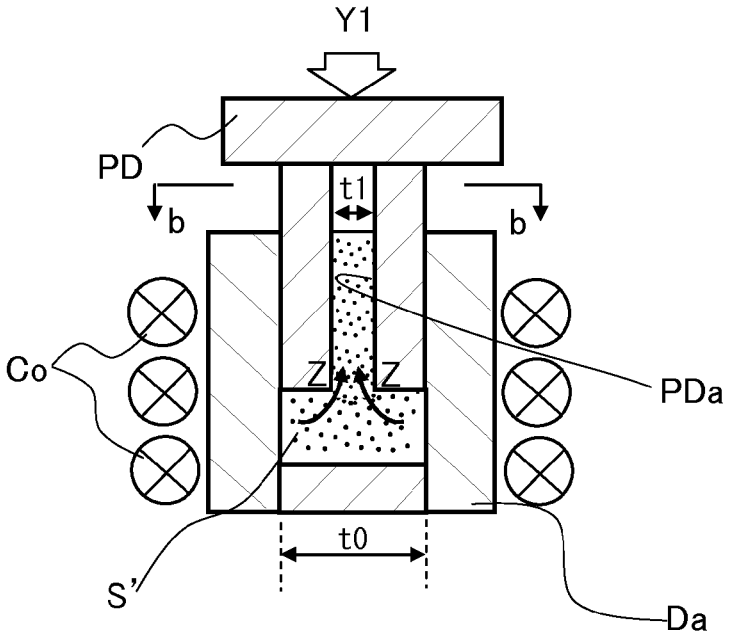
FIG. 3*a* schematically illustrates an extruding method at a second step of Embodiment 1 of the manufacturing method.
Figure 3B:
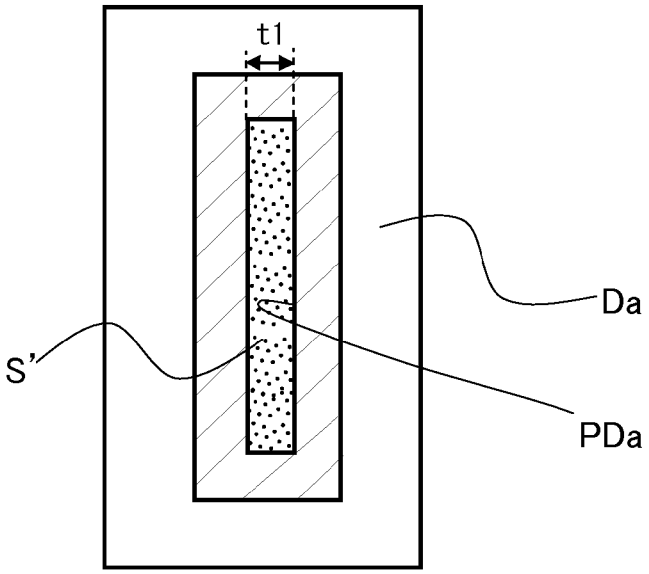
FIG. 3*b* is a view taken along the arrows b-b of FIG. 3*a*.
Figure 4A:
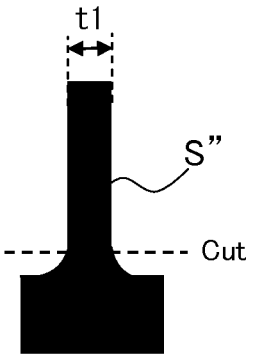
FIG. 4*a* schematically illustrates the state of a rare-earth magnet intermediary body prepared by extruding that is cut partially, and FIG. 4*b* schematically describes a method for upsetting at the second step.
Figure 4B:
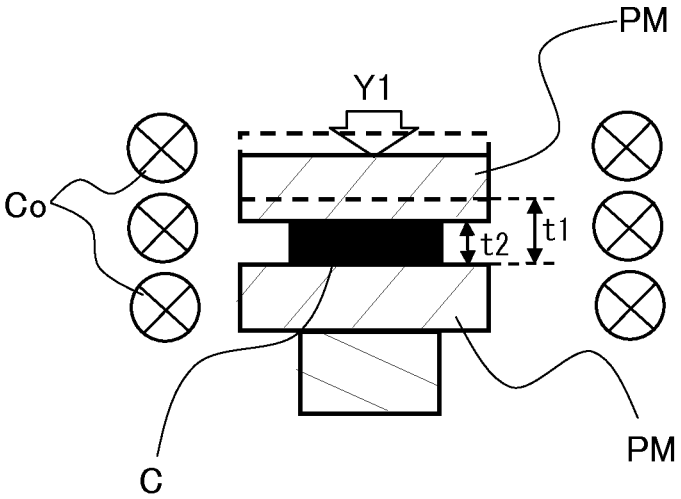

FIGS. 1*a* and 1*b* schematically illustrate a first step of a method for manufacturing a rare-earth magnet of the present invention in this order, and FIG. 2 illustrates the microstructure of a compact that is manufactured by the first step. FIG. 3*a* schematically illustrates an extruding method at a second step of Embodiment 1 of the manufacturing method, and FIG. 3*b* is a view taken along the arrows b-b of FIG. 3*a*. FIG. 4*a* schematically illustrates the state of a processed product prepared by extruding that is cut partially to describe the state of the intermediary body prepared, and FIG. 4*b* schematically describes a method for upsetting at the second step.

As illustrated in FIG. 1*a*, alloy ingot is molten at a high frequency, and a molten composition giving a rare-earth magnet is injected to a copper roll R to manufacture a melt-spun ribbon B by a melt-spun method using a single roll in an oven (not illustrated) under an Ar gas atmosphere at reduced pressure of 50 kPa or lower, for example. The melt-spun ribbon obtained is then coarse-ground.

Among the melt-spun ribbons that are coarse-ground, a melt-spun ribbon B having a maximum size of about 200 nm or less is selected, and this is loaded in a cavity defined by a carbide die D and a carbide punch P sliding along the hollow of the carbide die as illustrated in FIG. 1*b*. Then, ormic-heating is performed thereto while applying pressure with the carbide punch P (X direction) and letting current flow through in the pressuring direction, whereby a quadrangular-columnar compact S is manufactured, including a Nd—Fe—B main phase (having the grain size of about 50 nm to 200 nm) of a nano-crystalline structure and a Nd—X alloy (X: metal element) grain boundary phase around the main phase (first step). The content of RE is desirably 29 mass %≤RE≤32 mass %.

Herein, the Nd—X alloy making up the grain boundary phase is an alloy containing Nd and at least one type of Co, Fe, Ga and the like, which may be any one type of Nd—Co, Nd—Fe, Nd—Ga, Nd—Co—Fe, Nd—Co—Fe—Ga, or the mixture of two types or more of them and is in a Nd-rich state.

As illustrated in FIG. 2, the compact S shows an isotropic crystalline structure where the space between the nano-crystalline grains MP (main phase) is filled with the grain boundary phase BP.

After preparing the quadrangular-columnar compact S at the first step, extruding is performed thereto as illustrated in FIG. 3, and then upsetting is performed to the rare-earth magnet intermediary body prepared by the extruding as illustrated in FIG. 4, thus manufacturing a rare-earth magnet (orientational magnet) by the hot deformation processing including the extruding and the upsetting (second step). The following describes the second step in details.

Firstly, as illustrated in FIG. 3*a*, the compact prepared at the first step is placed in a die Da, followed by heating of the die Da with a high-frequency coil Co, thus preparing a compact S' in a heated state. Herein, prior to the placing of the compact, lubricant is applied to the inner face of the die Da and the inner face of the sheet-form hollow PDa of the extrusion punch PD.

The compact S' in the heated state is pressed with the extrusion punch PD having the sheet-form hollow PDa (Y1 direction), so as to reduce the thickness of the compact S' with this pressurization and extrude a part of the compact into the sheet-form hollow PDa (Z direction).

Herein, the ratio of processing during this extruding is represented by (t0−t1)/t0, and the processing with the ratio of processing of 60 to 80% is desirable.

As a result of this extruding, a rare-earth magnet intermediary body S" is prepared as illustrated in FIG. 4*a*. In this rare-earth magnet intermediary body S", a sheet-form part of t1 in thickness is cut, which is used at the following upsetting as the normal rare-earth magnet intermediary body.

That is, as illustrated in FIG. 4*b*, the rare-earth magnet intermediary body S" of t1 in thickness is placed between upper and lower punches PM (anvils), and the punches PM are heated with a high-frequency coil Co, so as to press the rare-earth magnet intermediary body S" with the upper punch PM in the thickness direction (Y1 direction) while applying heat thereto until the thickness is reduced from the original t1 to t2, whereby a rare-earth magnet C in the form of an orientational magnet can be manufactured.

Herein, the ratio of processing during this upsetting is represented by (t1−t2)/t1, and the processing with the ratio of processing of 10 to 30% is desirable.

Herein the rate of strain is adjusted at 0.1/sec. or more during extruding and upsetting of the hot deformation processing. When the degree of processing (rate of compression) by the hot deformation processing is large, e.g., when the rate of compression is about 10% or more, such hot deformation processing can be called heavily deformation processing.

Figure 5:
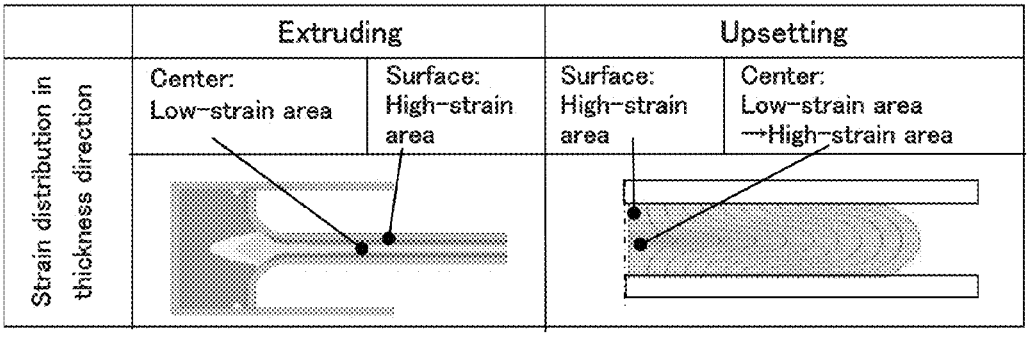
FIG. 5 describes the distribution of strains in a processed product during extruding and upsetting.

As is evident from FIG. 5 describing the distribution of strains in a processed product subjected to extruding and upsetting, the rare-earth magnet intermediary body prepared by the extruding performed firstly has an area of high degree of strains at the surface but has an area of low degree of strains at its center, meaning that anisotropy is insufficient at the center compared with the outer region.

Then, upsetting is performed to such a rare-earth magnet intermediary body, whereby strains are given favorably to the area of low degree of strains at its center while keeping the area of high degree of strains at the surface, whereby the center also can be an area of high-degree of strains, and so the rare-earth magnet manufactured can have high-degree of strains entirely.

In this way, hot deformation processing is performed at the second step in the order of extruding and upsetting, whereby the area of low degree of strains at the center area of the rare-earth magnet intermediary body that often occurs during extruding can have high-degree of strains given from the following upsetting, whereby the rare-earth magnet manufactured can have high-degree of strains at the entire area favorably, and accordingly the rare-earth magnet manufactured can have high degree of orientation and high remanence.

Figure 6:
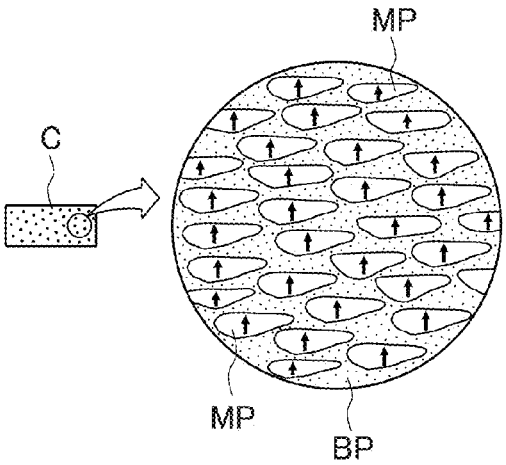
FIG. 6 illustrates the micro-structure of a rare-earth magnet (orientational magnet) manufactured of the present invention.

The rare-earth magnet C (orientational magnet) manufactured by hot deformation processing including the two stages of processing of extruding and upsetting includes flattened-shaped nano-crystalline grains MP as illustrated in FIG. 6, whose boundary faces that are substantially in parallel to the anisotropic axis are curved or bent, meaning that the orientational magnet C has excellent magnetic anisotropy.

The orientational magnet C in the drawing is excellent because it has a metal structure including a RE-Fe—B main phase (RE: at least one type of Nd and Pr, or Di (didymium) as an intermediate of them) and a RE-X alloy (X: metal element) grain boundary phase surrounding the main phase, the content of RE is 29 mass %≤RE≤32 mass %, and the main phase of the rare-earth magnet manufactured has an average grain size of 300 nm. Since the content of RE is within the range, the effect of suppressing cracks during hot deformation processing becomes higher, and higher degree of orientation can be guaranteed. Such a range of the content of RE further can ensure the size of the main phase achieving high remanence.

(Embodiment 2 of Manufacturing Method of a Rare-Earth Magnet)

Figure 7:
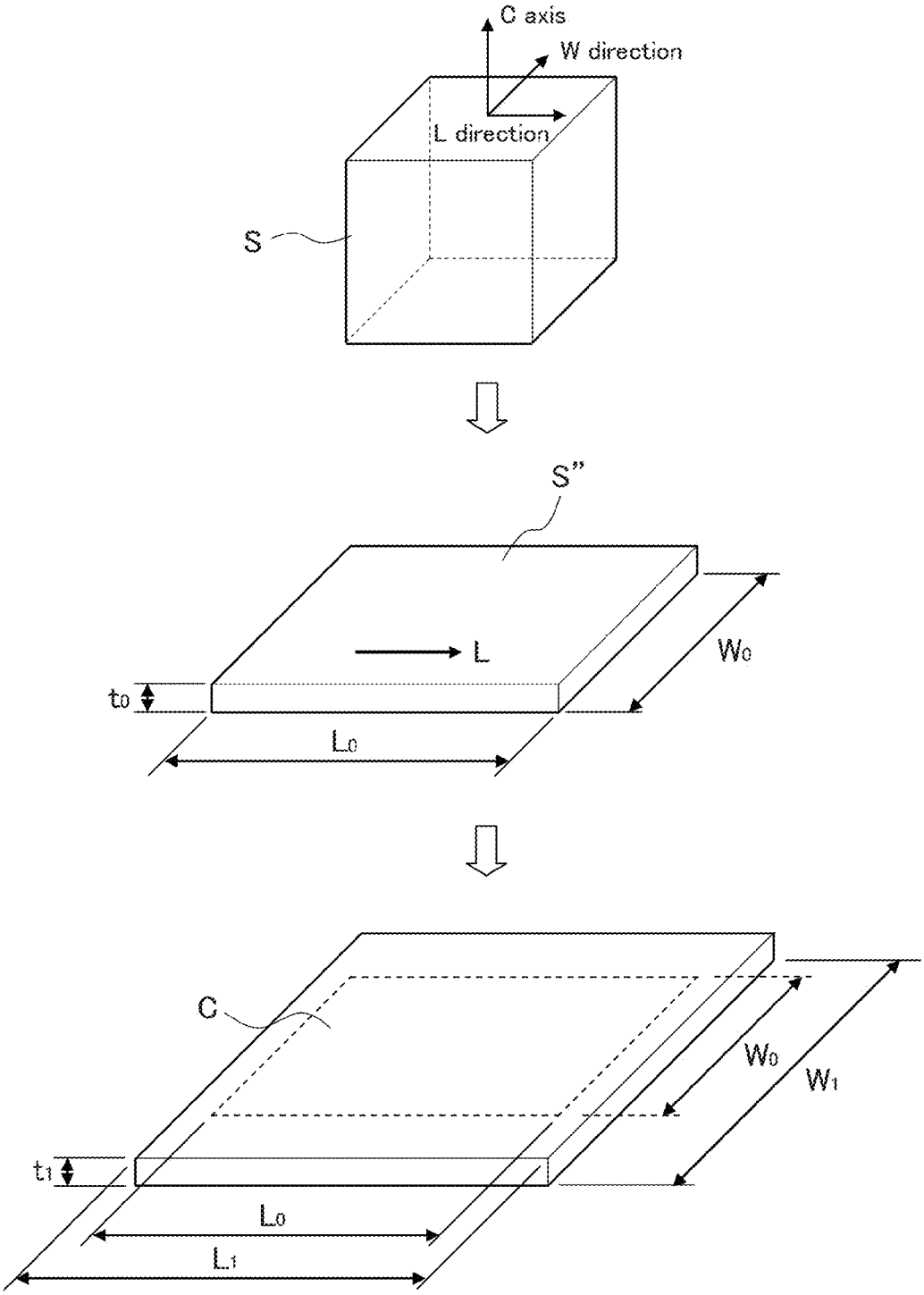
FIG. 7 schematically describes the second step of Embodiment 2 of the manufacturing method.

Referring next to FIG. 7, the following describes Embodiment 2 of the manufacturing method of a rare-earth magnet. Herein, FIG. 7 schematically describes another embodiment of the second step. That is, Embodiment 2 of the manufacturing method is similar to Embodiment 1 in the first step, and the second step thereof is modified.

A compact S prepared at the first step has a C-axis direction that is the easy magnetization direction, and a L-directional axis and a W-directional axis that define a face orthogonal to this C-axis direction. The extruding direction during extruding at the second step is this L direction (direction along the L-directional axis) and the direction orthogonal to the extruding direction during extruding is the W direction (direction along the W-directional axis).

The rare-earth magnet intermediary body S" (thickness $t_0$) prepared by extruding at the second step is extruded in the L direction during the extruding, and so it has small stretching in the W direction, whereas having large stretching in the L direction ($L_0>W_0$). That is, the rare-earth magnet intermediary body S" has greatly improved magnetic characteristics in the L direction but has magnetic characteristics in the W direction that is less improved. Then, at the upsetting following the extruding, stretching in the W direction is made larger than the stretching in the L direction this time ($W_1-W_0>L_1-L_0$), whereby the rare-earth magnet C (thickness $t_1$) manufactured has similar magnetic characteristics between in the L direction and in the W direction, and so anisotropy can be removed in the face defined with the L-directional axis and the W-directional axis. As a result, the anisotropy in the easy magnetization direction (C-axis direction) that is orthogonal to the face defined with this L-directional axis and the W-directional axis can be increased, and so remanence Br of the rare-earth magnet can be improved.

To this end, the dimensions of a mold to place the rare-earth magnet intermediary body S" therein are adjusted, and the rare-earth magnet intermediary body S" is placed in such a mold for forging, and the stretching in the L direction and in the W direction during upsetting is adjusted so that an in-plane anisotropy index: Br(W)/Br(L) becomes 1.2 or less, where Br(W) denotes the remanence in the W direction of the rare-earth magnet C after upsetting, and Br(L) denotes such remanence in the L direction.

It is known that the ratio of stretching in the W direction and stretching in the L direction during upsetting to yield the in-plane anisotropy index: Br(W)/Br(L) of 1.2 or less, that is, the stretching ratio in the W direction/the stretching ratio in the L direction is in the range of about 1 to 2.5. Then, the dimensions of a mold to be used for the upsetting are adjusted so as to yield such stretching ratios of both, and using such a mold with adjusted dimensions, a rare-earth magnet intermediary body S" is forged, whereby the stretching in the W direction and the stretching in the L direction can be controlled precisely.

As another method to yield the in-plane anisotropy index: Br(W)/Br(L) of 1.2 or less or the stretching ratio in the W direction/the stretching ratio in the L direction that is in the range of about 1 to 2.5, the dimensions of a plane defined with the L-directional axis and the W-directional axis of the sheet-form rare-earth magnet intermediary body prepared by extruding may be adjusted beforehand.

When a rare-earth magnet intermediary body having a rectangle in the planar view is crushed by pressing with punches or the like vertically without being constrained at their side faces, the stretching of the intermediary body along the short sides is larger than the stretching along the long sides due to friction generated between the upper and lower faces of the rare-earth magnet intermediary body and the upper and lower punches. This method utilizes such a difference in stretching between the long sides and the short sides, and the lengths in the L direction and in the W direction of the sheet-form rare-magnet intermediary body prepared by extruding are adjusted so that the stretching ratio in the W direction/the stretching ratio in the L direction becomes in the range of about 1 to 2.5 during upsetting, so that upsetting is performed to the rare-earth magnet intermediary body with the thus adjusted dimensions.

[Experiment to Confirm the Effect from Extruding and Upsetting, and Result Thereof]

The present inventors conducted an experiment to confirm the improvement in remanence of a rare-earth magnet as a whole by combining extruding and upsetting.

(First Method for Manufacturing Test Body)

A predetermined amount of rare-earth alloy raw materials (the alloy composition was Fe-30Nd-0.93B-4Co-0.4Ga in terms of at %) were mixed, which was then molten in an Ar atmosphere, followed by injection of the molten liquid thereof from an orifice of ϕ0.8 mm to a revolving roll made of Cu with Cr plating applied thereto for quenching, thus preparing alloy thin pieces. These alloy thin pieces were ground and screened with a cutter mill in an Ar atmosphere, whereby rare-earth alloy powder of 0.2 mm or less was obtained. Next, this rare-earth alloy powder was placed in a carbide die of 20×20×40 mm in size, which was sealed with carbide punches vertically. Next, this was set in a chamber, and a pressure inside of the chamber was reduced to $10^{-2}$ Pa. Then load of 400 MPa was applied thereto while heating to 650° C. by a high-frequency coil for pressing. The state after this pressing was held for 60 seconds, and a compact (bulk) was taken out from the die to be a compact for hot deformation processing.

Next, the compact was placed in a die illustrated in FIG. 3, and the die was heated by the high-frequency coil so that the temperature of the compact increased to about 800° C. by heat transferred from the die, to which extruding was performed at the rate of stroke of 25 mm/sec. (strain rate of about 1/sec.) and with the processing ratio of 70%. After that, an intermediary body prepared was taken out from the die, and the intermediary body as a sheet-form part only was cut out as illustrated in FIG. 4. Such a cut sheet-form intermediary body was placed on the die (anvil) as illustrated in FIG. 4*b*, and the anvil was heated similarly by the high-frequency coil so that the intermediary body was heated to 800° C. by heat transferred from the die, to which upsetting was performed at the rate of stroke of 4 mm/sec. (strain rate of about 1/sec.) and with the processing ratio of 25%. In this way, a test body of a rare-earth magnet was obtained.

Figure 8:
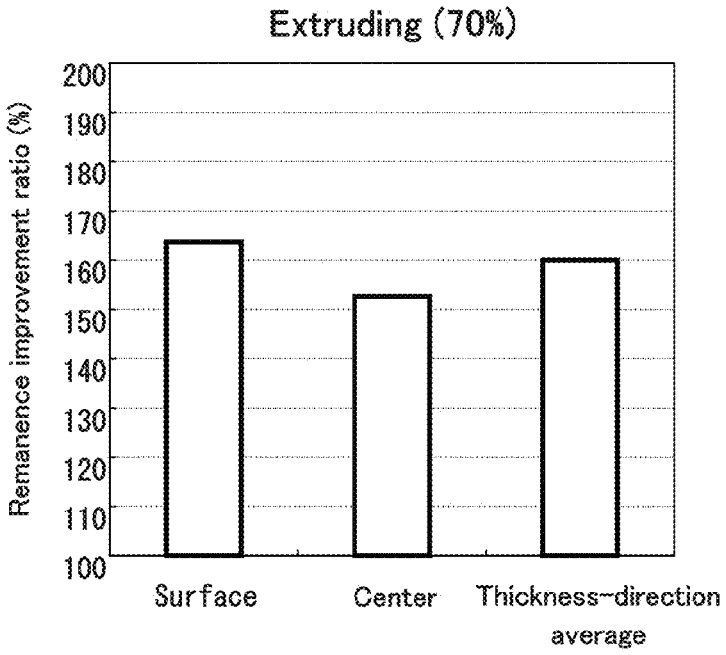
FIG. 8 illustrates a result of the experiment on the remanence improvement ratio at each part of a rare-earth magnet prepared by extruding with the processing ratio of 70%.
Figure 9:
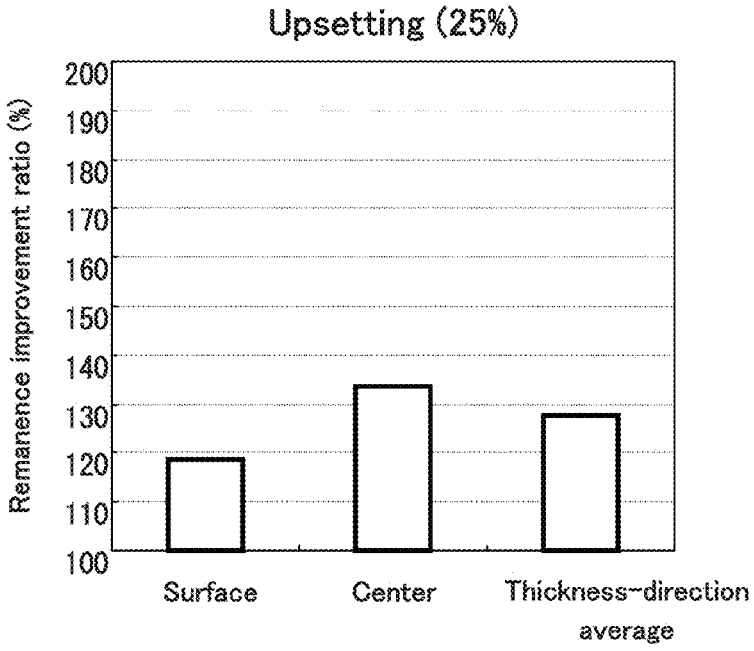
FIG. 9 illustrates a result of the experiment on the remanence improvement ratio at each part of a rare-earth magnet prepared by upsetting with the processing ratio of 25%.
Figure 10:
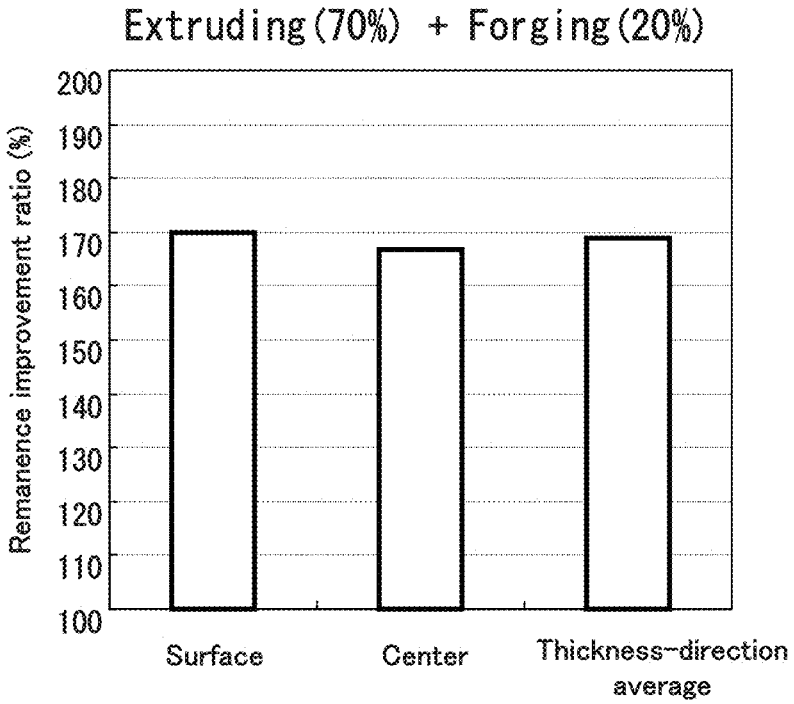
FIG. 10 illustrates a result of the experiment on the remanence improvement ratio at each part of a rare-earth magnet prepared by extruding with the processing ratio of 70% and by upsetting with the processing ratio of 25%.

FIG. 8 illustrates a result of the experiment on the remanence improvement ratio at each part of a rare-earth magnet prepared by extruding with the processing ratio of 70%. FIG. 9 illustrates a result of the experiment on the remanence improvement ratio at each part of a rare-earth magnet prepared by upsetting with the processing ratio of 25%. Then FIG. 10 illustrates a result of the experiment on the remanence improvement ratio at each part of a rare-earth magnet prepared by extruding with the processing ratio of 70% and by upsetting with the processing ratio of 25%.

FIG. 8 shows that the processed product by extruding had remanence at its center that was lower by about 10% than the remanence at the surface. That compares with FIG. 9 showing that the processed product by upsetting had remanence at its center that was rather higher by about 10% than the remanence at the surface. Then FIG. 10 shows that the processed product by these extruding and upsetting had the same degree of remanence at the surface and the center, demonstrating that the remanence at a part close to the center that had low remanence after the extruding was improved by the upsetting, and so the product as a whole had the same degree of high remanence.

[Experiment to Specify the Optimum Range of Processing Ratio for Extruding and Upsetting, and Result Thereof]

Figure 11:
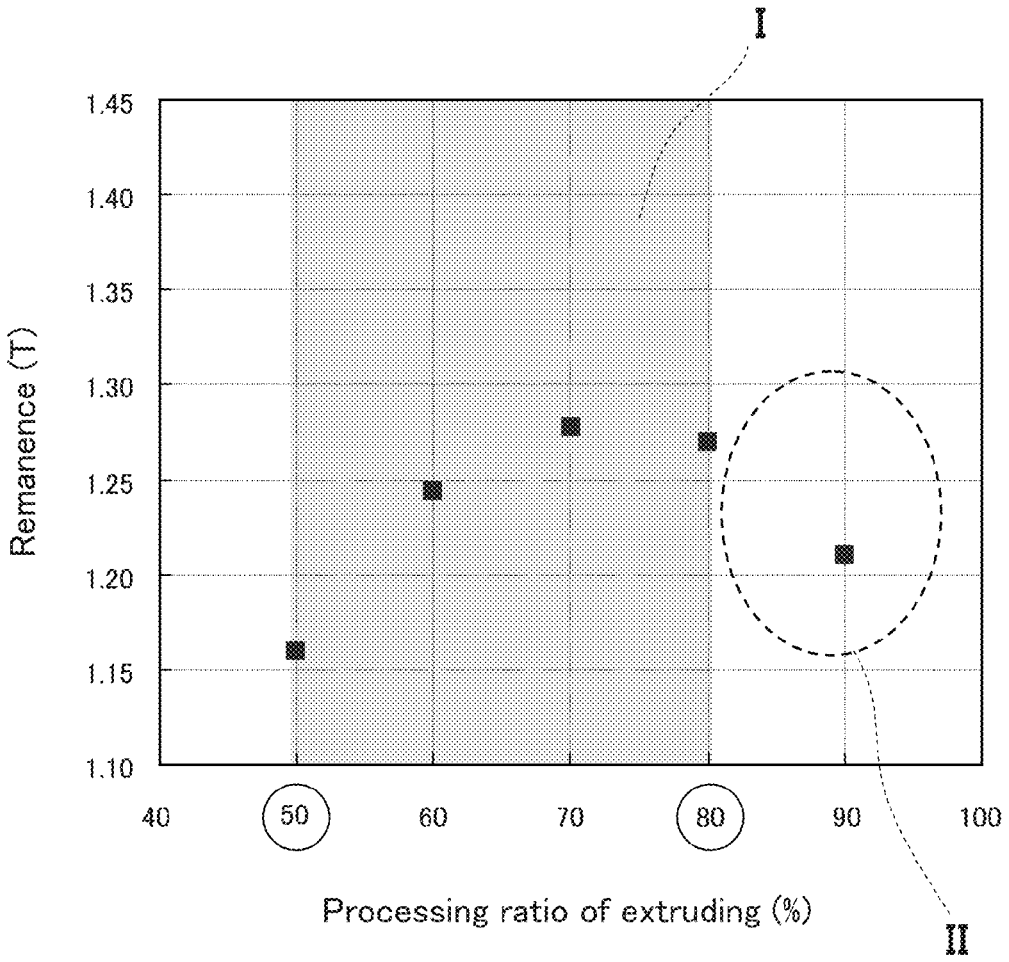
FIG. 11 illustrates an experimental result on the relationship between the processing ratio of extruding and the remanence.
Figure 12:
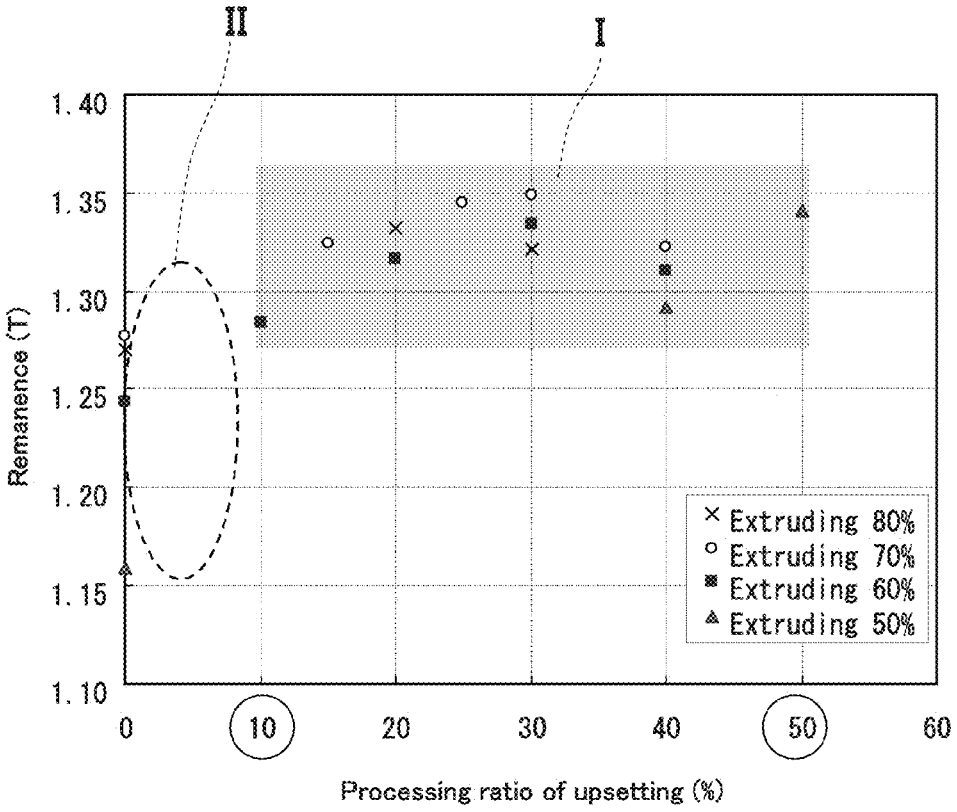
FIG. 12 illustrates an experimental result on the relationship between the processing ratios for extruding and upsetting and the remanence.

The present inventors further conducted an experiment to specify the optimum range of the processing ratios for the extruding and the upsetting. In this experiment, test bodies were prepared while changing the ratios of processing for each of extruding and upsetting, and the magnetic characteristics (remanence and coercive force) of the test bodies were measured. Table 1 shows the processing ratios for extruding and upsetting and results of the magnetic characteristics of the test bodies. FIG. 11 is a graph representing the cases of extruding only based on Table 1 and FIG. 12 is a graph representing all of the results of Table 1.

As shown in Table 1 and FIG. 11, when the processing ratio of extruding was in the range of less than 50%, remanence at the time of extruding was low, and so the amount of processing during upsetting increased. As a result, the rare-earth magnet manufactured generated cracks at the periphery. When the processing ratio of extruding was in the range exceeding 80% (area II in FIG. 11), strains at the time of extruding were too large, and so cracks occurred in the crystalline structure. As a result, the rare-earth magnet manufactured had low remanence.

On the other hand, when the processing ratio of the extruding was in the range of 50% to 80% (area I in FIG. 11), the rare-earth magnet manufactured had the highest remanence. Such a rare-earth magnet, however, had a low amount of strains at the center part, meaning that the rare-earth magnet as a whole did not have high remanence only by such extruding. Herein, although the remanence with the processing ratio of 50% during extruding was smaller than that with the processing ratio of 90%, such remanence can be increased by performing upsetting later. When the processing ratio of extruding was 90%, cracks occurred, and so upsetting cannot be performed thereto.

Then extruding may be performed with the processing ratio in the range of 50% to 80%, and then upsetting may be performed thereto. Herein Table 1 and FIG. 12 show that, when the processing ratio during upsetting was in the range of less than 10% (area II in FIG. 12), strains were not given to the center of the rare-earth magnet sufficiently, and so the rare-earth magnet as a whole did not have high remanence, which was found by CAE analysis by the present inventors that was conducted to evaluate the distribution of strains when upsetting was simply performed to a cylindrical-columnar model (the coefficient of friction at this time was set at 0.3).

Meanwhile, in the range of the processing ratio for upsetting that was higher than about 50%, cracks occurred due to tensile stress at the periphery of the rare-earth magnet, which was found by CAE analysis by the present inventors similarly to the area II.

In this way, the results of the experiments and CAE analyses by the present inventors demonstrate that extruding

TABLE 1

| | extruding | | | upsetting | | | magnetic characteristics | |
|---|---|---|---|---|---|---|---|---|
| No. | processing ratio (%) | temp. (° C.) | strain rate (/sec) | processing ratio (%) | temp. (° C.) | strain rate (/sec) | remanence (T) | coercive force (kOe) |
| 1 | 70 | 800 | 1 | 15 | 800 | 1 | 1.32 | 13.51 |
| 2 | | | | 25 | | | 1.35 | 13.44 |
| 3 | | | | 30 | | | 1.35 | 12.67 |
| 4 | | | | 0 | — | | 1.28 | 14.68 |
| 5 | 60 | | | 0 | | | 1.24 | 14.54 |
| 6 | | | | 10 | 800 | 1 | 1.28 | 14.51 |
| 7 | | | | 20 | | | 1.32 | 13.19 |
| 8 | | | | 30 | | | 1.33 | 13.62 |
| 9 | | | | 40 | | | 1.31 | 13.70 |
| 10 | 50 | | | 0 | — | | 1.16 | 13.44 |
| 11 | | | | 40 | 800 | 1 | 1.29 | 12.07 |
| 12 | | | | 50 | | | 1.34 | 13.50 |
| 13 | 80 | | | 0 | — | | 1.27 | 15.00 |
| 14 | | | | 20 | 800 | 1 | 1.33 | 13.41 |
| 15 | | | | 30 | | | 1.32 | 13.56 |
| 16 | 90 | | | 0 | — | | 1.21 | 13.20 |

Note:

For conversion of the unit of coercive force kOe into the International System of Unit (SI) (kA/m), the coercive force was calculated by multiplying it by 79.6.

with the processing ratio in the range of 50% to 80%, followed by upsetting with the processing ratio of 10 to 50% successfully yielded a rare-earth magnet free from cracks, having high remanence as a whole and having excellent magnetic characteristics.

[Experiment to Examine Magnetic Characteristics while Changing the Stretching Ratio in W Direction and the Stretching Ratio in L Direction During Upsetting, and Result Thereof]

For the manufacturing of a rare-earth magnet whose anisotropy in the easy magnetization direction (C-axis direction) is improved, thus having high remanence, the present inventors have come up with the technical idea of reducing, at the time of upsetting, a difference in stretching between in the extruding direction (L direction) and in the direction orthogonal thereto (W direction) that is generated during extruding, thus canceling the anisotropy in the plane defined with the L-directional axis and the W-directional axis of the rare-earth magnet intermediary body prepared by the extruding, and so improving the anisotropy in the direction orthogonal to this plane (C-axis direction). Then, five test bodies having different stretching ratios in the W direction and stretching ratios in the L direction during upsetting were prepared, and the relationship between the stretching ratio in the W direction/stretching ratio in the L direction and the stretching ratio in each direction was specified. Then, the relationship between the stretching ratio in the W direction/stretching ratio in the L direction and remanence in the easy magnetization direction: Br was specified.

(Second Method for Manufacturing Test Body)

The test bodies were prepared similarly to that of the first method for manufacturing test body as stated above until the sheet-form part of the intermediary body was cut out, and then anvil was heated by the high-frequency coil so that the intermediary body was heated to 800° C. by heat transferred from the die, to which upsetting was performed at the rate of stroke of 4 mm/sec. (strain rate of about 1/sec.) and with the processing ratio of 30%. In this way, a test body of a rare-earth magnet was obtained.

Figure 13:
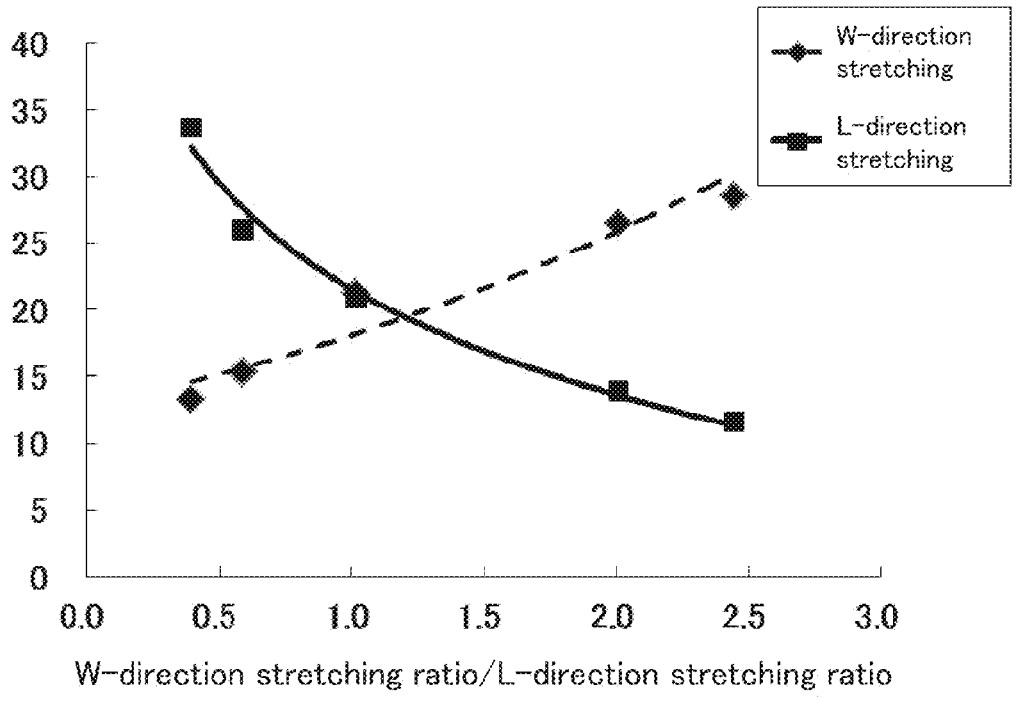
FIG. 13 illustrates an experimental result to specify the relationship between the stretching ratio in the W direction/the stretching ratio in the L direction and the stretching ratio in each direction.

These test bodies were controlled for their stretching ratio in the W direction/stretching ratio in the L direction of a rare-earth magnet illustrated in FIG. 7: $\{(W_1-W_0)/W_0\}/\{(L_1-L_0)/L_0\}$ to be five levels from 0.4 to 2.5. Table 2 below shows the stretching ratios in the W direction and in the L direction and the stretching ratio in the W direction/the stretching ratio in the L direction of the test bodies, and the like, and FIG. 13 illustrates the relationship between the stretching in the W direction/the stretching in the L direction and the stretching ratio in each direction.

TABLE 2

| test body No. | compression ratio in thickness direction (%) | stretching ratio in W direction (%) | stretching ratio in L direction (%) | stretching ratio in W direction/stretching ratio in L direction |
|---|---|---|---|---|
| 1 | 30 | 13.31 | 33.66 | 0.4 |
| 2 | 30 | 15.35 | 26.04 | 0.6 |
| 3 | 30 | 21.18 | 20.82 | 1.0 |
| 4 | 30 | 26.50 | 13.90 | 2.0 |
| 5 | 30 | 28.49 | 11.66 | 2.5 |

Next, remanence of the five test bodies (magnetization in the C-axis direction) was measured. Table 3 and FIG. 14 show the result of the measurement.

TABLE 3

| test body No. | W/L | remanence in C-axis direction: Br(T) number of measurements: 3 | |
|---|---|---|---|
| 1 | 0.4 | 1.342 | 1.337 |
| | | 1.327 | |
| | | 1.342 | |
| 2 | 0.6 | 1.347 | 1.345 |
| | | 1.341 | |
| | | 1.346 | |
| 3 | 1.0 | 1.374 | 1.367 |
| | | 1.364 | |
| | | 1.354 | |
| 4 | 2.0 | 1.372 | 1.370 |
| | | 1.369 | |
| | | 1.370 | |
| 5 | 2.5 | 1.372 | 1.375 |

Figure 14:
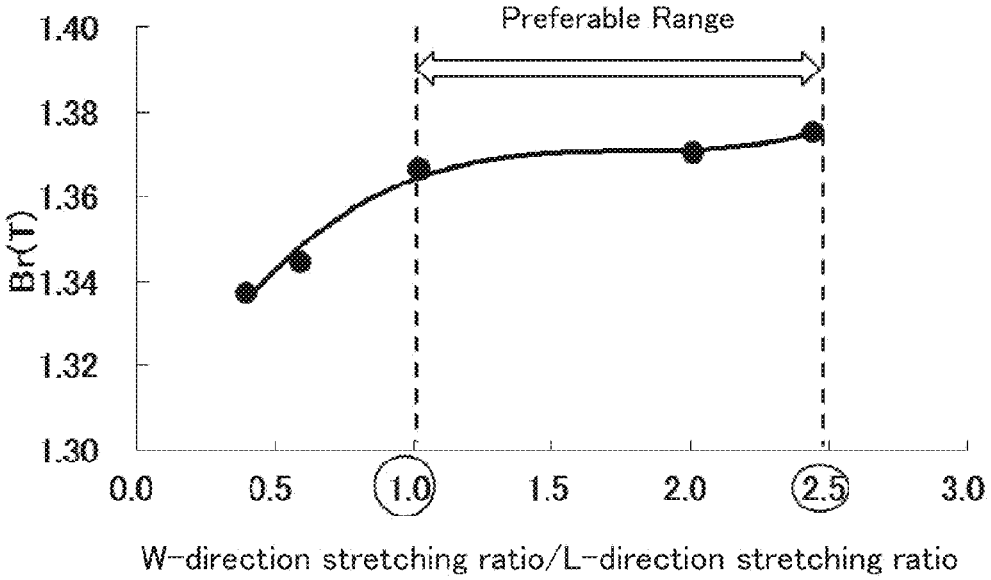
FIG. 14 illustrates an experimental result to specify the relationship between the stretching ratio in the W direction/the stretching ratio in the L direction and the remanence Br in the easy magnetization direction.

From Table 1 and FIG. 14, it can be confirmed that the stretching ratio in the W direction/the stretching ratio in the L direction reached an inflection point at 1.0, and in the range of 1.0 to 2.5, they kept high values of remanence. Test bodies No. 3 to No. 5 had high remanence, which results from small in-plane anisotropy in the plane defined with the L-directional axis and the W-directional axis (the plane orthogonal to the C-axis direction).

From a separate experimental result described later, it was found that when the stretching ratio in the W direction/the stretching ratio in the L direction exceeds 2.5, then the in-plane anisotropy index exceeds 1.20, which deviates from the specified range of 1.20 or less, and therefore the range of the stretching ratio in the W direction/the stretching ratio in the L direction that is 1.0 to 2.5 is a preferable range.

[Experiments to Specify the Relationship Between in-Plane Anisotropy Index and Remanence and the Relationship Between Stretching Ratio in the W Direction/Stretching Ratio in the L Direction and in-Plane Anisotropy Index, and Result Thereof]

Figure 15:
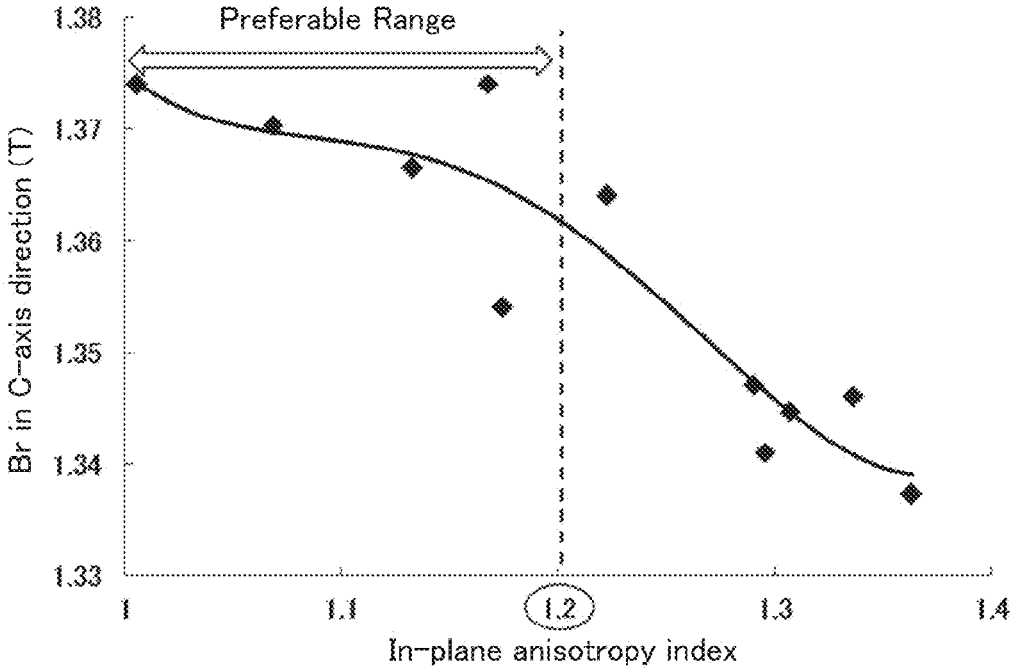
FIG. 15 illustrates an experimental result to specify the relationship between the in-plane anisotropy index and the remanence Br in the C-axis direction.

The present inventors prepared a lot of test bodies to specify the relationship between in-plane anisotropy index and remanence of rare-earth magnets (residual flux density in the C-axis direction). Herein the in-plane anisotropy index is an index represented with the ratio between the remanence Br(W) in the W direction of a rare-earth magnet after upsetting and the remanence Br(L) in the L direction thereof, i.e., Br(W)/Br(L). FIG. 15 illustrates the result of the experiment.

From FIG. 15, it was confirmed that the remanence reached an inflection point when the in-plane anisotropy index was 1.2, and in the range of 1.2 or less, high remanence around 1.37T was obtained. Based on this experimental result, the stretching in the L direction and the stretching in the W direction during upsetting may be adjusted so that the in-plane anisotropy index Br(W)/Br(L) that is represented with the ratio between the remanence Br(W) in the W direction of a rare-earth magnet after upsetting and the remanence Br(L) in the L direction thereof becomes 1.2 or less.

Figure 16:
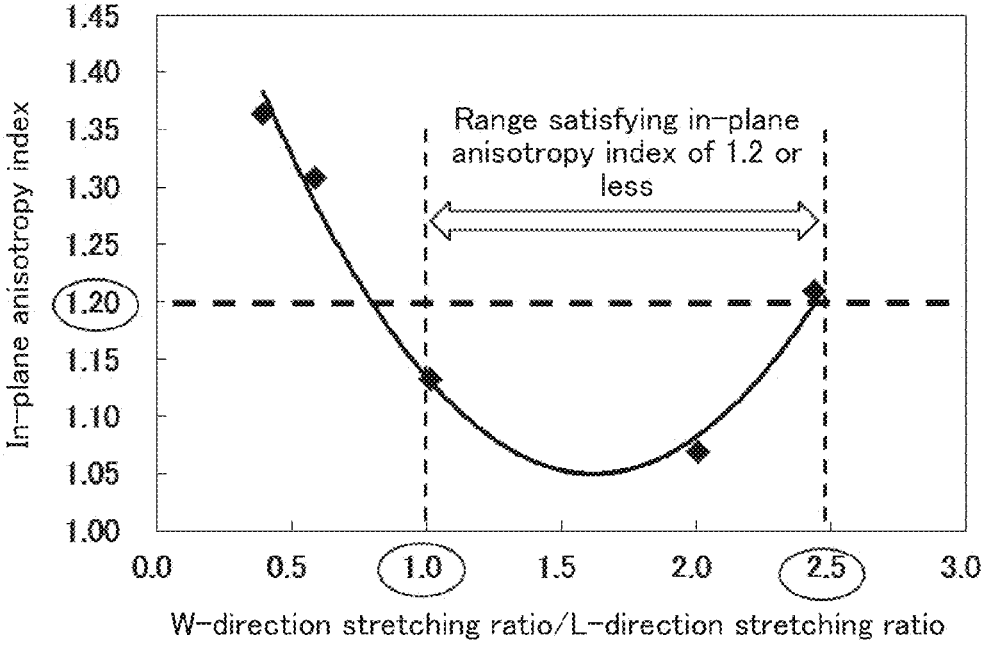
FIG. 16 illustrates an experimental result to specify the relationship between the stretching ratio in the W direction/the stretching ratio in the L direction, the in-plane anisotropy index and the remanence Br in the C-axis direction.

Next, the relationship between the stretching ratio in the W direction/the stretching ratio in the L direction and the in-plane anisotropy index was examined as well. FIG. 16 illustrates the result of the experiment.

FIG. 16 shows that the range of the graph relating the stretching ratio in the W direction/the stretching ratio in the L direction to the in-plane anisotropy index, in which the in-plane anisotropy index was 1.2 or less, substantially agrees with the range of the stretching ratio in the W direction/the stretching ratio in the L direction as stated above that is 1.0 to 2.5. Then, it is expected that, in the range of the stretching ratio in the W direction/the stretching ratio in the L direction exceeding 2.5, the in-plane anisotropy index will exceed 1.2. Based on this result, the stretching in the L direction and the stretching in the W direction during upsetting may be adjusted so that the in-plane anisotropy index: Br(W)/Br(L) becomes 1.2 or less, or the ratio between the stretching in the L direction and the stretching in the W direction during upsetting: the stretching ratio in the W direction/the stretching ratio in the L direction becomes in the range of 1 to 2.5.

[Observation of Structures of Test Bodies Having Different in-Plane Anisotropy Indexes and Result Thereof]

Figure 17:
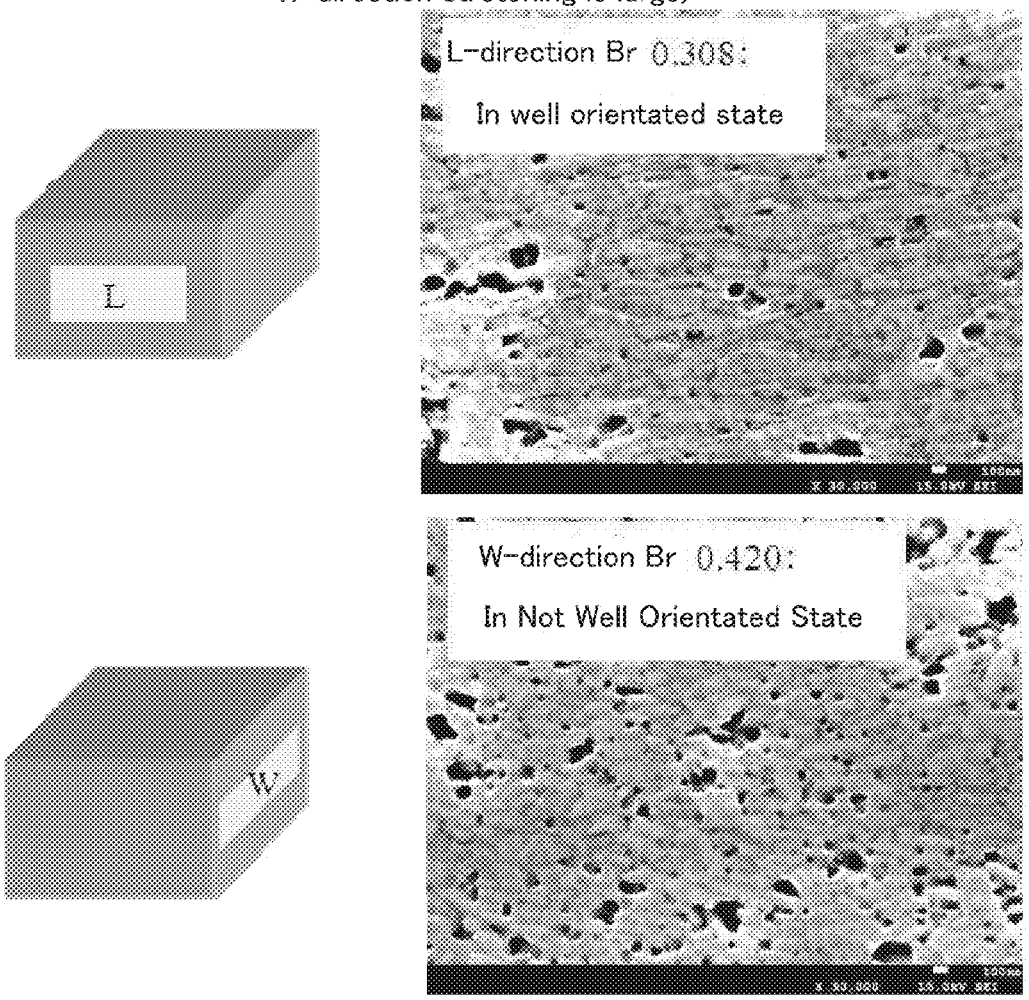
FIG. 17 illustrates a SEM image of a crystal structure of a rare-earth magnet in the L direction and in the W direction when there is a large difference in stretching between in the L direction and in the W direction.
Figure 18:
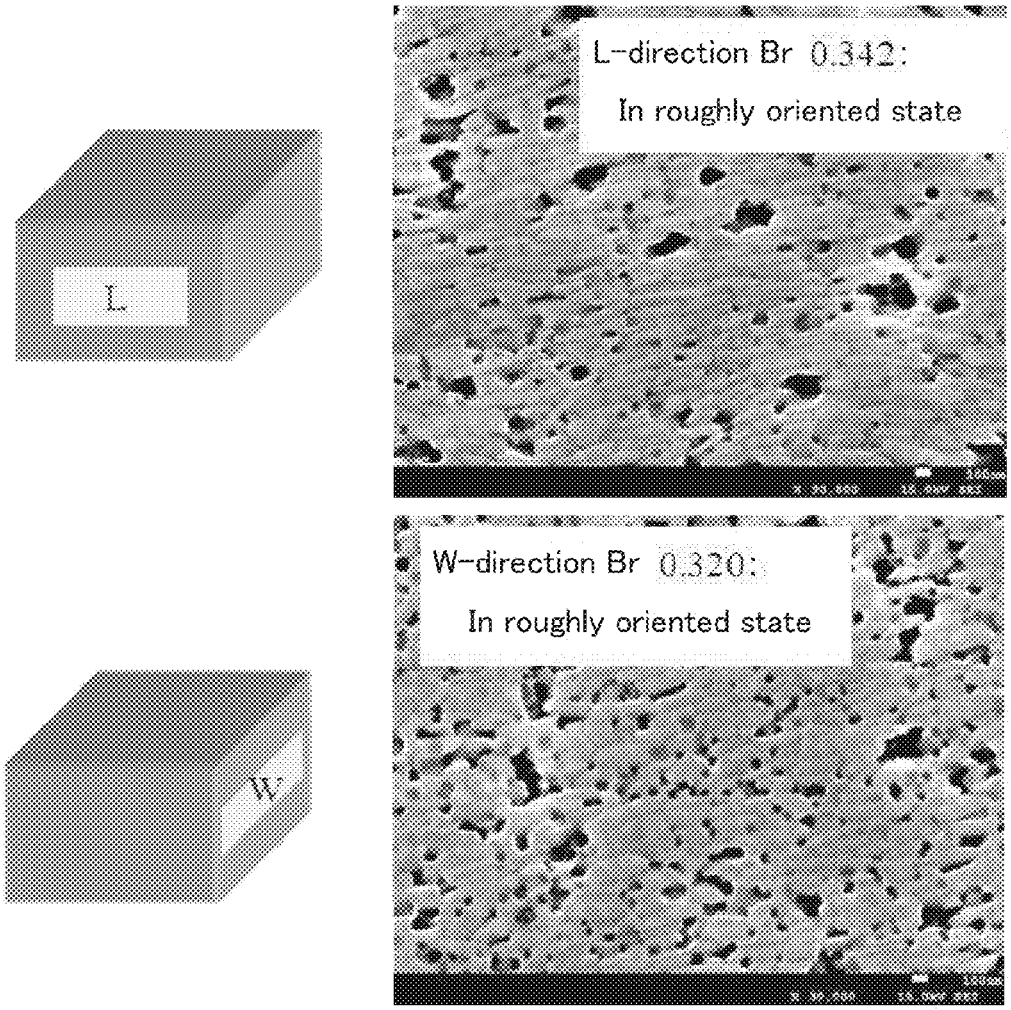
FIG. 18 illustrates a SEM image of a crystal structure of a rare-earth magnet in the L direction and in the W direction when there is a small difference in stretching between in the L direction and in the W direction.

The present inventors then specified the in-plane anisotropy indexes of the test bodies shown in Tables 2 and 3. Table 4 below shows the result. Then test body No. 1 having the in-plane anisotropy index exceeding 1.2 and test body No. 4 having that of 1.2 or less were observed for their structures. FIGS. 17 and 18 illustrate their SEM images.

TABLE 4

| test body No. | W/L | remanence in C-axis direction Br(T) number of measurements: 3 | | remanence in W direction Br(T) | remanence in L direction Br(T) | stretching ratio in W direction (%) | stretching ratio in L direction (%) | in-plane anisotropy index |
|---|---|---|---|---|---|---|---|---|
| 1 | 0.4 | 1.342<br>1.327<br>1.342 | 1.337 | 0.420 | 0.308 | 13.31 | 33.66 | 1.36 |
| 2 | 0.6 | 1.347<br>1.341<br>1.346 | 1.345 | 0.408 | 0.312 | 15.35 | 26.04 | 1.31 |
| 3 | 1.0 | 1.374<br>1.364<br>1.354 | 1.367 | 0.314 | 0.356 | 21.18 | 20.82 | 1.13 |
| 4 | 2.0 | 1.372<br>1.369<br>1.370 | 1.370 | 0.320 | 0.342 | 26.50 | 13.90 | 1.07 |
| 5 | 2.5 | 1.372<br>1.375<br>1.379 | 1.375 | 0.355 | 0.293 | 28.49 | 11.66 | 1.21 |

As in the SEM image of FIG. 17, test body No. 1 having the in-plane anisotropy index exceeding 1.2 had a good orientation state in the L direction, but had a poor orientation state in the W direction, resulting in that the value of remanence in the C-axis direction was low of 1.337.

On the other hand, as in the SEM image of FIG. 18, test body No. 4 having the in-plane anisotropy index of 1.2 or less had the same degree of orientation state in the L direction and in the W direction, resulting in that the value of remanence in the C-axis direction was high of 1.370.

These observation results show that, when the in-plane anisotropy index is low of 1.2 or less, and the orientation state is the same degree between the two axes in the plane, a rare-earth magnet manufactured can have high remanence in the C-axis direction of about 1.37.

Although the embodiments of the present invention have been described in details with reference to the drawings, the specific configuration is not limited to these embodiments, and the design may be modified without departing from the subject matter of the present invention, which falls within the present invention.

REFERENCE SIGNS LIST

R Copper roll
B Melt-spun ribbon (rapidly quenched ribbon)
D Carbide die
P Carbide punch
PD Extrusion punch (anvil)
PDa Sheet-form hollow
Da Die
Co High-frequency coil
PM Punch (anvil)
S Compact
S' Compact in heated state
S" Rare-earth magnet intermediary body
C Rare-earth magnet (orientational magnet)
RM Rare-earth magnet
MP Main phase (nano-crystalline grains, crystalline grains, crystals)
BP Grain boundary phase

The invention claimed is:

1. A method for manufacturing a rare-earth magnet, comprising:

a first step of press-forming powder as a rare-earth magnetic material to form a compact, the powder including a RE-Fe—B main phase RE: at least one type of Nd and Pr and an RE-X alloy X: metal element grain boundary phase around the main phase; and a second step of performing hot deformation processing to the compact to give magnetic anisotropy to the compact, thus manufacturing the rare-earth magnet, wherein the hot deformation processing at the second step includes two steps that are extruding performed to prepare a rare-earth magnet intermediary body and upsetting performed to the rare-earth magnet intermediary body to manufacture the rare-earth magnet, the extruding is to place a compact in a die, and apply pressure to the compact with an extrusion punch so as to reduce a thickness of the compact for extrusion to prepare the rare-earth magnet intermediary body having a sheet form, and the upsetting is to apply pressure to the sheet-form rare-earth magnet intermediary body in the thickness direction to reduce the thickness, thus manufacturing the rare-earth magnet, wherein for the sheet-form rare-earth magnet intermediary body prepared by the extruding, a direction for the extruding is L direction, a direction orthogonal to the direction for the extruding is W direction, and a direction that is orthogonal to a plane defined with an axis in the L direction and an axis in the W direction and that is in the thickness direction of the sheet-form rare-earth magnet intermediary body is a C-axis direction that is an easy magnetization direction, stretching in the L direction and stretching in the W direction during the upsetting are adjusted so that an in-plane anisotropy index: Br(W)/Br(L) becomes 1.2 or less, the in-plane anisotropy index: Br(W)/Br(L) being represented with a ratio between remanence Br(W) in the W direction and remanence Br(L) in the L direction of the rare-earth magnet after the upsetting.

2. The method for manufacturing a rare-earth magnet according to claim 1, wherein a processing ratio of a distribution of strains in the extruding is 50 to 80% and a processing ratio of a distribution of strains in the upsetting is 10 to 50%.

3. The method for manufacturing a rare-earth magnet according to claim 1, wherein stretching in the L direction and stretching in the W direction are adjusted so that a ratio between a stretching ratio in the W direction and a stretching ratio in the L direction during the upsetting: the stretching ratio in the W direction/the stretching ratio in the L direction ranges from 1 to 2.5.

4. The method for manufacturing a rare-earth magnet according to claim 3, wherein a mold for the upsetting has dimensions adjusted so that the ratio between the stretching ratio in the W direction and the stretching ratio in the L direction during the upsetting: the stretching ratio in the W direction/the stretching ratio in the L direction ranges from 1 to 2.5, and a rare-earth magnet intermediary body is placed in the mold for the upsetting.

5. The method for manufacturing a rare-earth magnet according to claim 3, wherein dimensions of a plane defined with the axis in the L direction and the axis in the W direction of the rare-earth magnet intermediary body prepared by the extruding are adjusted for the upsetting so that the ratio between the stretching ratio in the W direction and the stretching ratio in the L direction during the upsetting: the stretching ratio in the W direction/the stretching ratio in the L direction ranges from 1 to 2.5.

* * * * *